US005216837A

United States Patent [19]

Cleaver et al.

[11] Patent Number: 5,216,837

[45] Date of Patent: Jun. 8, 1993

[54] ENCLOSED LOUVER MECHANISM

[75] Inventors: Jay R. Cleaver, Lafayette; Richard E. LaMay; Ivan Dusevic, both of West Lafayette, all of Ind.

[73] Assignee: Lafayette Venetian Blind, Inc., West Lafayette, Ind.

[21] Appl. No.: 958,097

[22] Filed: Oct. 7, 1992

[51] Int. Cl.[5] ..... E05F 17/00; E06B 7/096

[52] U.S. Cl. ..... 49/82.1; 49/74.1

[58] Field of Search ..... 49/82 GR, 74 L; 454/224, 221, 278

[56] References Cited

U.S. PATENT DOCUMENTS

| | | | |
|---|---|---|---|
| 425,542 | 4/1890 | Hantsche, Jr. | 49/82 GR |
| 595,854 | 12/1897 | Lansing | 49/82 GR |
| 2,898,035 | 8/1959 | Wheeler | 49/82 GR |
| 2,903,257 | 9/1959 | Perrone | 49/82 GR |
| 3,201,832 | 8/1965 | Hordis et al. | 49/82 GR |
| 3,702,040 | 11/1972 | Roy . | |
| 3,746,042 | 7/1973 | Finkel . | |
| 3,758,988 | 9/1973 | Tachikawa . | |
| 3,991,518 | 11/1976 | Ishihara . | |
| 4,505,070 | 3/1985 | Clipp et al. . | |
| 4,655,003 | 4/1987 | Henley, Sr. . | |
| 4,834,163 | 5/1989 | Dickstein . | |
| 4,887,391 | 12/1989 | Briggs, Sr. . | |
| 4,974,362 | 12/1990 | Briggs, Sr. . | |
| 5,029,413 | 7/1991 | Jovanovic . | |
| 5,052,150 | 10/1991 | Chen . | |

*Primary Examiner*—Philip C. Kannan
*Attorney, Agent, or Firm*—Woodard, Emhardt, Naughton Moriarty & McNett

[57] ABSTRACT

An enclosed louver actuating mechanism is disclosed which employs generally a rack and pinion gear system for actuating a plurality of louvers. The louver mechanism is configured so that upon manual rotation of one louver the remaining louvers are rotated. The louver mechanism is contained within a longitudinal slot in a stile of a louvered panel and includes a plurality of pinion gears enmeshed between opposing longitudinal gear racks. A pinion gear is provided for each louver and is located in the stile between the gear racks so that the longitudinal gear racks translate in opposite directions relative the pinion gears. A longitudinal cover encloses the rack and pinion drive mechanism and includes through holes corresponding to the pinion gears and louvers. Drive pins are received through the longitudinal cover between the louvers and pinion gears.

20 Claims, 8 Drawing Sheets

ENCLOSED LOUVER MECHANISM

BACKGROUND OF THE INVENTION

The present invention relates generally to louver mechanisms and, in particular, to an enclosed louver mechanism contained within a louvered panel for actuating a plurality of louvers.

Various louver mechanisms have been developed to simultaneously actuate a plurality of louvers of a louvered panel and/or window covering. Many of these mechanisms employ a tilt rod or other such actuating member which is external of the louvered panel to actuate the louvers. Although functionally able to open and close the louvers, these designs are not as aesthetically pleasing since the actuating member is always visible. Additionally, in the case of a tilt rod for example, the end of the tilt rod not attached to the louver mechanism can sometimes swing into and interfere with the louvers to further detract from both the function and aesthetics of the louvered panel.

In response, some louver or shutter designs have been developed which employ a louver mechanism without a tilt rod. These designs instead are configured so that manual adjustment of one louver causes a like adjustment of the remaining louvers. Examples of these designs can be found in U.S. Pat. Nos. 4,887,391 and 4,974,362 to Briggs. Although perhaps aesthetically pleasing, the shutters disclosed in Briggs '391 and '362 are limited in their range of motion and cannot be rotated through a full 180° of rotation. A full 180° of rotation is often desirable to provide a choice of light transmission patterns through the louvers at a given partially closed position. For example, to prevent a passerby from being able to look into a first floor window while still allowing light to enter through the window, it is desirable to be able to adjust the louvers partially closed with the louvers angled downward toward the window. Conversely, to prevent a passerby from being able to look up into a second floor window while still allowing light to enter through the window, it is desirable to be able to adjust the louvers partially closed with the louvers angled upward toward the window.

Additionally, the louvered panels disclosed in Briggs '391 and '362 are pivotable about their respective ends and, as a result, require an increased operating envelope to permit full extension of the louvers when in their open position. A reduced clearance envelope adjacent the louvered panel is preferred, however, to provide greater flexibility when decorating adjacent to the louvered panel and to further minimize the potential for interference with or damaging of the louvered panel.

With these thoughts in mind, a need exists for an improved louver mechanism. Such a louver mechanism should not include unsightly tilt rods or other exposed actuating mechanisms. Additionally, such a louver mechanism should be capable of movement through a full 180° of rotation and should have a reduced operating envelope. Further, such a louver mechanism should be easily and reliably adjustable between its various open and closed positions.

SUMMARY OF THE INVENTION

An enclosed louver mechanism for actuating a number of louvers is disclosed in one embodiment of the present invention including a longitudinal housing having a longitudinal slot therein. First and second longitudinal gear racks are slidably disposed in the slot, and a number of pinion gears corresponding to the number of louvers are received in the slot between the gear racks with the gear teeth of the pinion gears meshing with the gear teeth of the gear racks. Each of the pinion gears includes means for receiving a drive pin therein. A longitudinal cover is received in the slot and encloses the gear racks and the pinion gears in the housing. The cover includes a number of locating holes extending therethrough and corresponding to the number of pinion gears. Drive pins are provided for connecting the louvers to the pinion gears, wherein each of the drive pins includes a pinion engaging end and a louver engaging end. The pinion engaging end is received through one of the locating holes and in a corresponding one of the pinion gears. The louver engaging end is received in a corresponding one of the louvers.

One object of the present invention is to provide an improved louver mechanism.

Another object of the present invention is to provide an louver mechanism completely enclosed within a louvered panel.

Yet another object of the present invention is to provide a louver mechanism which is movable through a full 180° of rotation.

Still yet another object of the present invention is to provide a louver mechanism having a reduced operating envelope.

Still another object of the present invention is to provide a louver mechanism which is easily and reliably movable between its various open and closed positions.

These and other objects and advantages of the present invention will become apparent from the following drawings and written description.

DESCRIPTION OF THE PREFERRED EMBODIMENT

Figure 1:
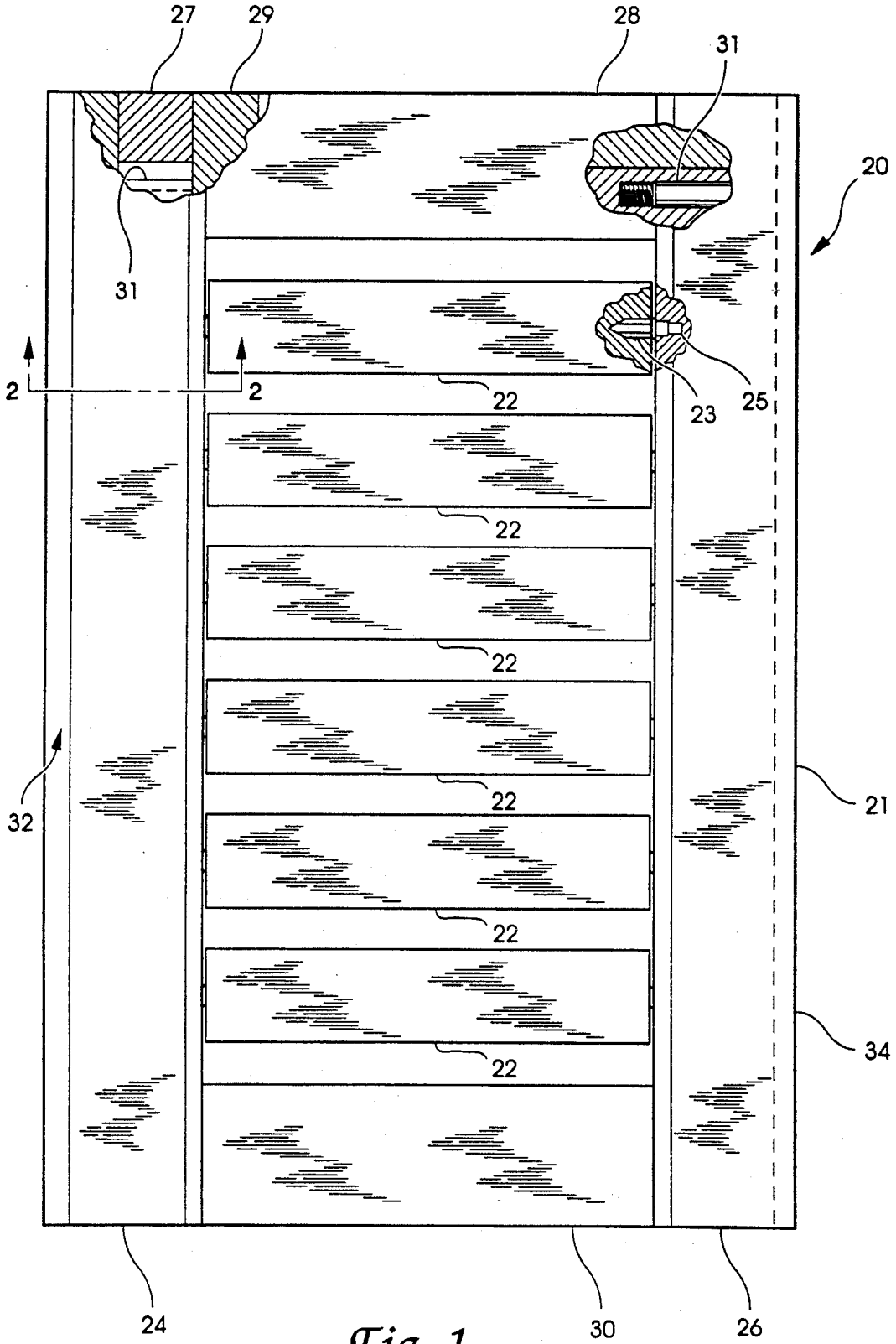
FIG. 1 is a front elevational, partial cut-away view of a louvered panel according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a louvered panel 20 is shown including generally a frame 21 containing a plurality of louvers 22 rotationally mounted therein. Frame 21 includes stiles 24 and 26 in connection with cross members 28 and 30. In the preferred embodiment, frame 21 is constructed of wood and employs generally a tongue-in-groove construction held together by a combination of adhesives and fasteners 31. Other materials and constructions known in the art are also contemplated. For example, frame 21 can be constructed of aluminum and employ fasteners to connect its various components.

Preferably, louvered panel 20 is adapted for placement adjacent to or in connection with like louvered panels. As shown in FIG. 1, panel 20 includes an open faced groove 32 extending along the length of stile 24 and a corresponding flange 34 extending along the length of stile 26 to avoid a gap between adjacent panels at an installation site. Other flange and groove configurations and connections known in the art are also contemplated. In another embodiment, for example, panel 20 might be hinged to an adjacent like panel to provide a folding window covering.

Figure 1A:
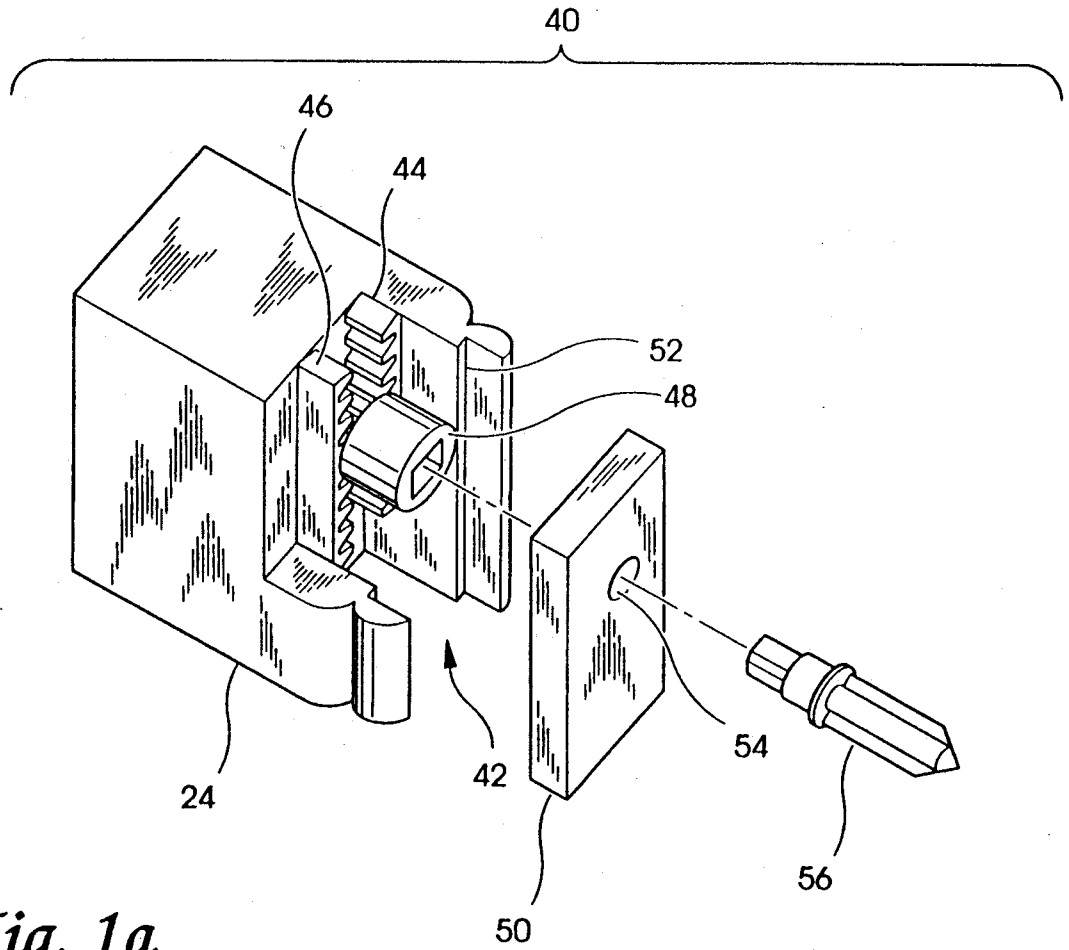
FIG. 1*a* is a perspective view depicting the assembly of a louver mechanism for actuating the louvers of the louvered panel shown in FIG. 1.

Referring now also to FIG. 1*a*, a portion of louvered panel 20 is presented depicting the assembly of an enclosed louver mechanism 40. Louver mechanism 40 is in connection with the plurality of louvers 22 and, upon rotation of one or more individual louvers, simultaneously actuates the remaining louvers. Louver mechanism 40 includes generally a rack and pinion gear mechanism for simultaneously actuating the plurality of louvers 22. As such, external tilt rods or other such actuating mechanisms are eliminated since the rack and pinion mechanism provides the mechanical advantage necessary for movement of louvers 22 by hand. To operate the louver mechanism, the user simply moves one louver to cause a like adjustment of the remaining louvers.

As shown in FIG. 1*a*, louver mechanism 40 is adapted to be housed within stile 24 for all louvers 22. To minimize cost and complexity, the other stile 26 has corresponding holes or bores 25 receiving pins 23 to support the opposite ends of louvers 22. In the preferred embodiment, louver pins 23 are secured in the louvers and are rotatably received in the holes 25 for rotationally connecting the louvers to stile 26. However, some applications may require louver mechanisms 40 in both stiles 24 and 26.

Louver mechanism 40 includes generally a covered housing for receiving the rack and pinion mechanism therein, wherein drive pins corresponding to the individual louvers are received through the cover and are engaged with individual pinions. In FIG. 1*a*, stile 24 includes a longitudinal slot 42 for housing the rack and pinion mechanism. Other embodiments are contemplated, however, in which the housing is a separate component received in the stile. For example, the housing could be a rectangular U-shaped aluminum channel received in stile 24. The choice of housing will vary according to the particular application, wherein louvered panels employed in harsh environments and subjected to water damage are likely to include a separate housing to resist warpage. Conversely, indoor applications having a controlled environment are likely to employ merely the rectangular slot 42 machined in stile 24 as shown in FIG. 1*a*.

Figure 2:
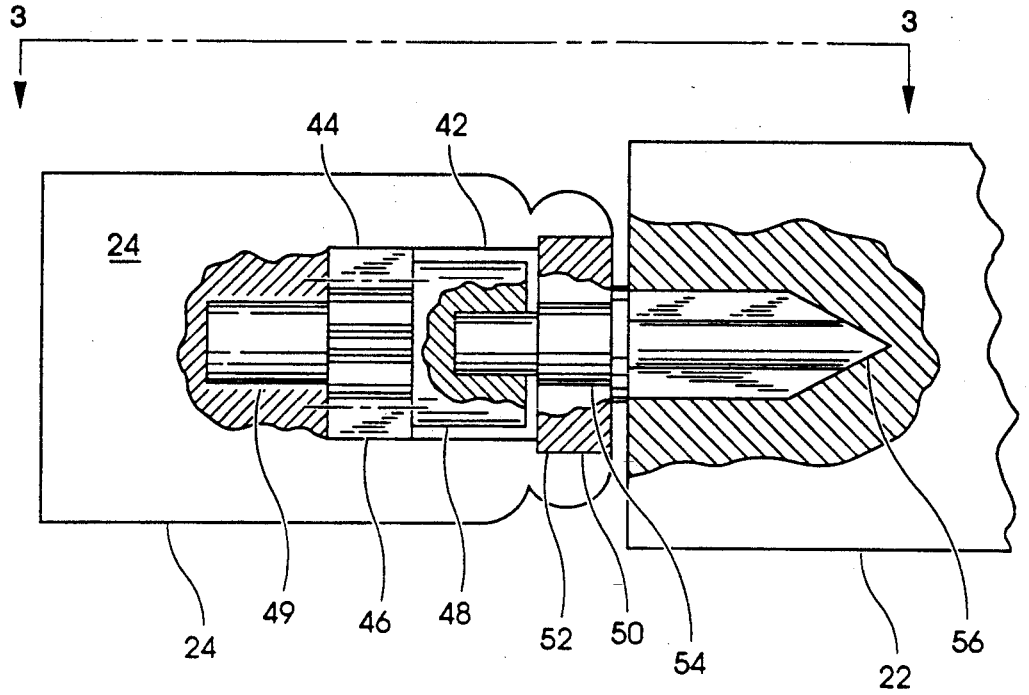
FIG. 2 is a cross-sectional, partial cut-away view taken along line 2—2 in the direction of the arrows shown in FIG. 1 and depicting the louver mechanism connected to one of the louvers.
Figure 3:
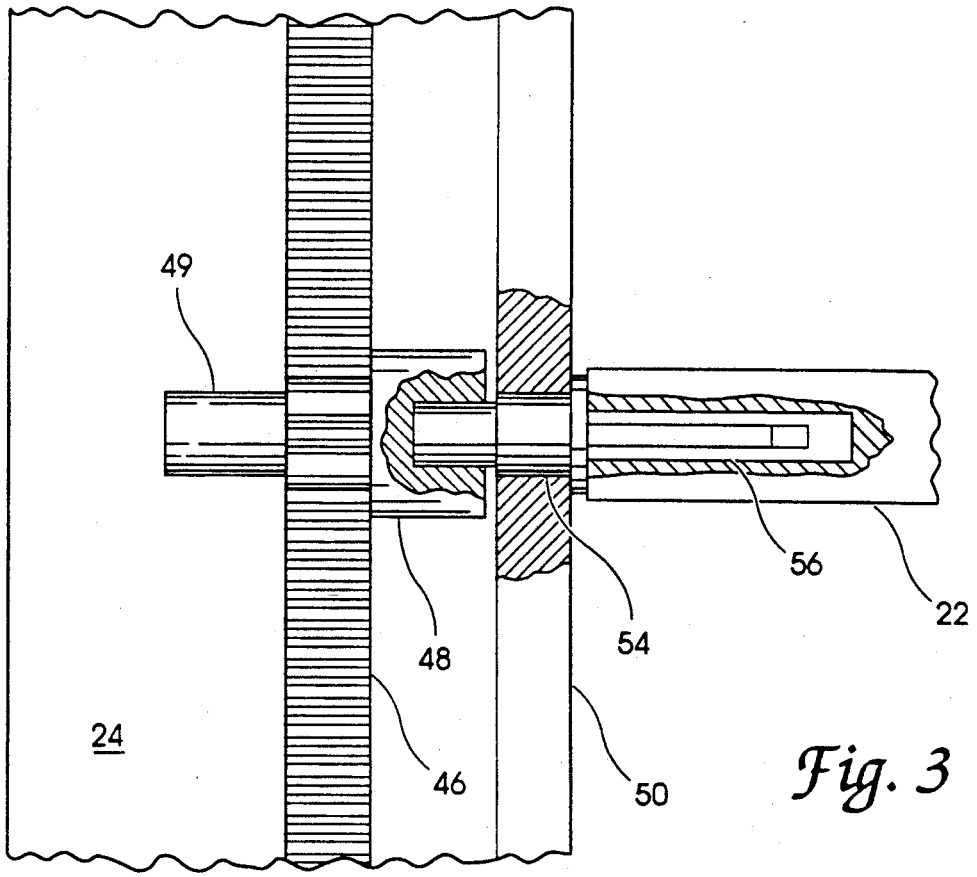
FIG. 3 is a cross-sectional, partial cut-away view taken along line 3—3 in the direction of the arrows shown in FIG. 2 and depicting the louver mechanism connected to one of the louvers.

Referring now also to FIGS. 2 and 3, contained within slot 42 and hidden from view are first and second longitudinal gear racks 44 and 46, respectively, and a plurality of pinion gears 48 corresponding to the number of movable louvers in the panel. Pinion gears 48 mesh with both longitudinal gear racks 44 and 46 such that rotation of one pinion gear 48 causes longitudinal racks 44 and 46 to translate in opposite directions within slot 42. As discussed further in connection with FIGS. 13–17, in the preferred embodiment at least one of the pinion gears 48 is rotationally mounted within hole or bore 49 of stile 24 to secure the rack and pinion mechanism relative to the housing.

To enclose the rack and pinion assembly, a longitudinal cover 50 is received within slot 52 of stile 24 flush with the edge of stile 24. Longitudinal cover 50 includes a plurality of through holes 54 corresponding to the plurality of louvers 22 and pinion gears 48. A drive pin 56 fixed in louver 22 is received through longitudinal cover 50 and engages with pinion gear 48 to complete the enclosed louver mechanism. When assembled with louver 22 received over drive pin 56, the entire louver mechanism is hidden from view save for a very small portion of drive pin 56 visible only through the clearance between louvers 22 and stile 24.

Referring back to FIG. 1, to completely enclose the louver mechanism 40 within stile 24, the ends of the stile 24 are sealed by fixing a block 27 within the exposed ends of slot 42. Further, the tongue-in-groove connection between stile 24 and cross member or rail 28, for example, is modified such that tongue member 29 on stile 24 is received in corresponding grooves of cross member 28 and cover 50. Adhesives are also employed between the block 27, tongue member 29, cross member 28 and stile 24 to ensure a rigid, sealed connection. A similar connection is provided at the opposite end of stile 24 with cross member 30.

As shown in FIGS. 2 and 3, pinion gear 48 is trapped between longitudinal cover 50 and the bottom of slot 42 to prevent the pinion gear from jumping out of engagement with longitudinal racks 44 and 46 upon actuation, thereby ensuring a smooth and reliable operation of the rack and pinion mechanism. Further, the width of slot 42 is sized to maintain pinion gear in engagement with both gear racks 44 and 46.

Figure 4:
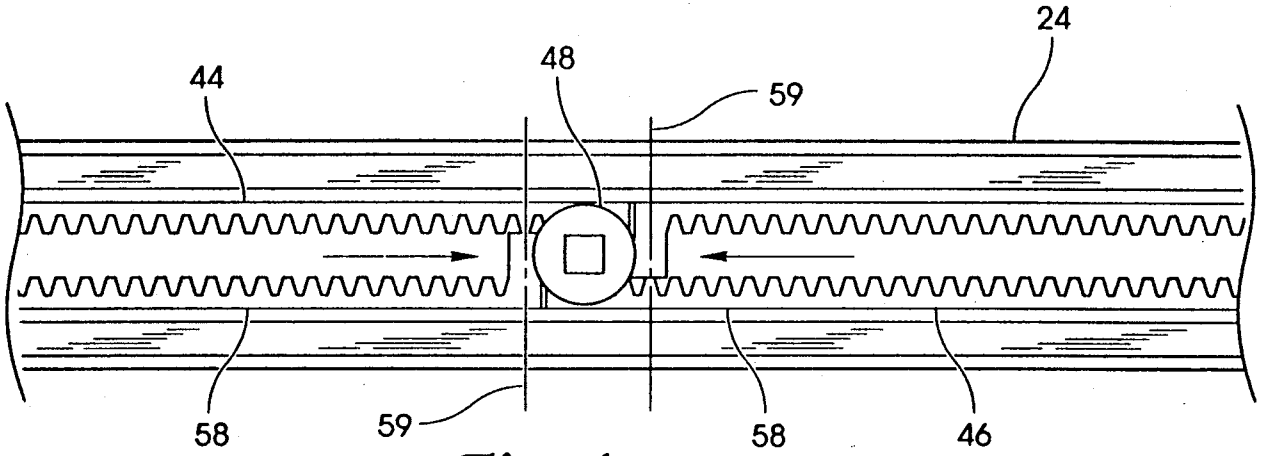
FIG. 4 is a view of the louver mechanism in the panel stile of FIG. 1 with the longitudinal cover removed and exposing opposing gear racks at one end of their travel adjacent to a pinion gear.
Figure 5:
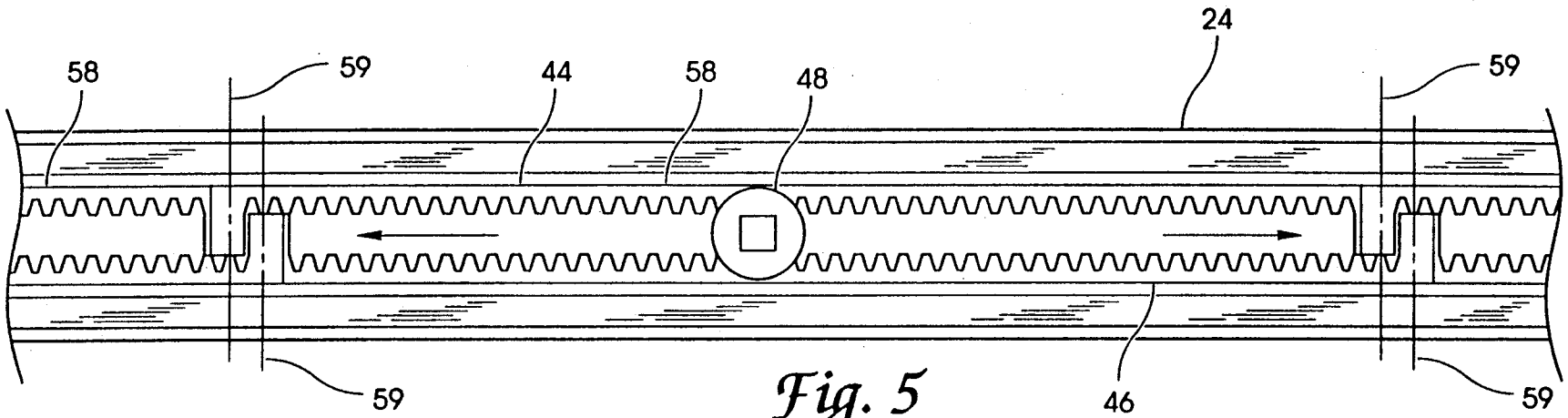
FIG. 5 is a view of the louver mechanism as shown in FIG. 4 with the longitudinal cover removed and exposing the opposing gear racks at the other end of their travel adjacent to each other.
Figure 6:
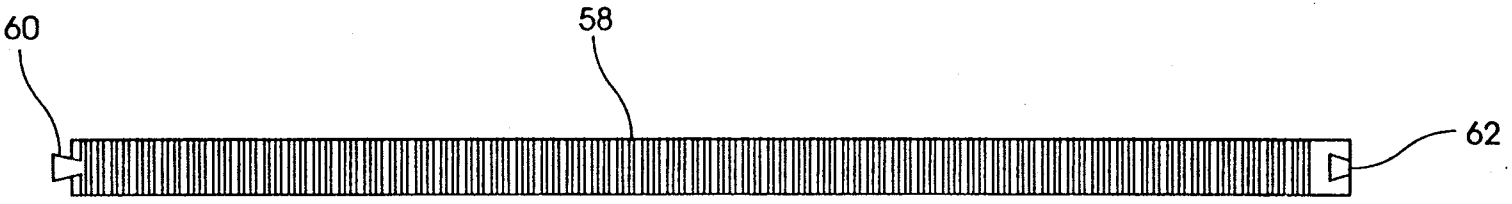
FIG. 6 is a view of a gear rack segment of the louver mechanism shown in FIG. 1*a*.
Figure 7:
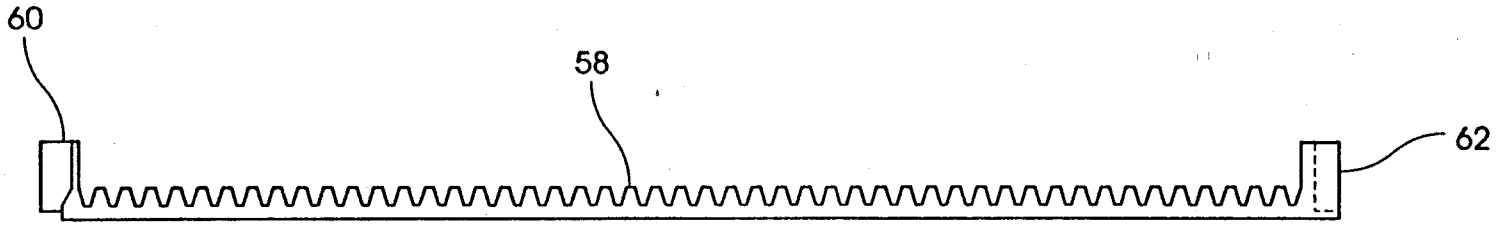
FIG. 7 is a side elevational view of the gear rack segment shown in FIG. 6.

Referring now to FIGS. 4–7, the construction of the longitudinal gear racks is shown in greater detail. Longitudinal gear racks 44 and 46 are assemblies of gear rack segments 58 interconnected with other like gear rack segments. Each gear rack segment 58 includes a dovetail construction for ease of assembly and disassembly with a mating gear rack segment. A tongue 60 extends from an end of segment 58 and is slidably received along a horizontal axis 59 within a corresponding groove 62 of an adjacent gear rack segment. As shown in FIGS. 4 and 5, the tongue-in-groove construction of longitudinal gear racks 44 and 46 also provides limits or mechanical stops which prevent longitudinal gear racks 44 and 46 from exceeding a predetermined range of motion.

In FIG. 4, a first limit to the relative motion between gear racks 44 and 46 is shown with the tongue and groove portions (as indicated at axis 59) of the gear rack segments abutting pinion gear 48. In FIG. 5, a second opposite limit to the range of motion is shown with the tongue and groove portions of the gear rack segments abutting each other. Therefore, to ensure a full range of travel of the louvers through 180° of rotation, louvers 22 are nominally connected to the louver mechanism at their full open positions with the gear rack assemblies midway between the first and second limits shown in FIGS. 4 and 5. Gear rack segments 58 are of sufficient length to ensure a ±90° of rotation of the louver from this nominal position, thereby yielding a full 180° of motion. However, it is also contemplated that the gear rack segments be of a shorter length to provide built-in mechanical stops at less than the full 180° of rotation. For example, some applications may require a minimum ventilation through the louvered panel which can be tailored by adjusting the length of the gear rack segments.

Figure 8:
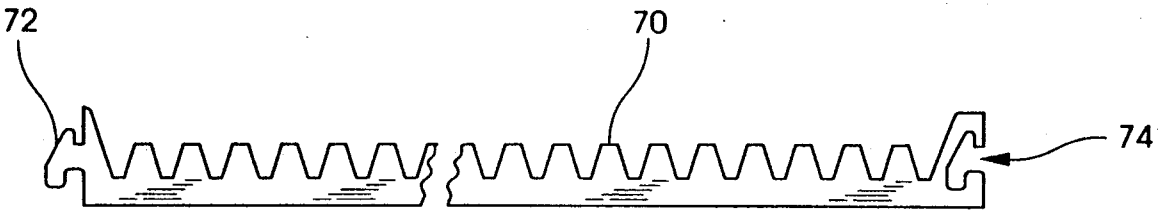
FIG. 8 is a side elevational view of an alternate gear rack segment of the louver mechanism shown in FIG. 1*a*.
Figure 9:
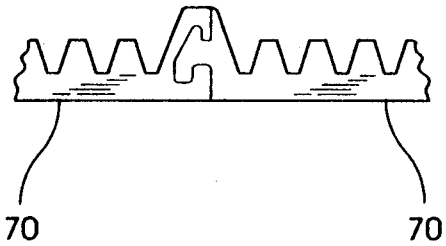
FIG. 9 is a partial, side elevational view of the gear rack segment shown in FIG. 8 connected with another like gear rack segment.

Other gear rack segment connections are contemplated as well. Referring now to FIGS. 8 and 9, an alternate gear rack segment 70 is shown which employs an alternate tongue-in-groove construction including tongue 72 slidably received in a corresponding groove 74. In this embodiment, tongue 70 is slidably received along into place within corresponding groove 74 as shown in FIG. 9.

Figure 10:
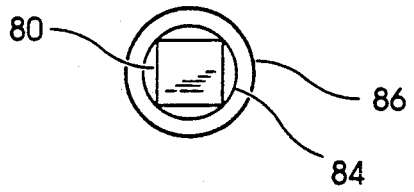
FIG. 10 is a top plan view of a drive pin of the louver mechanism shown in FIG. 1*a*.
Figure 11:
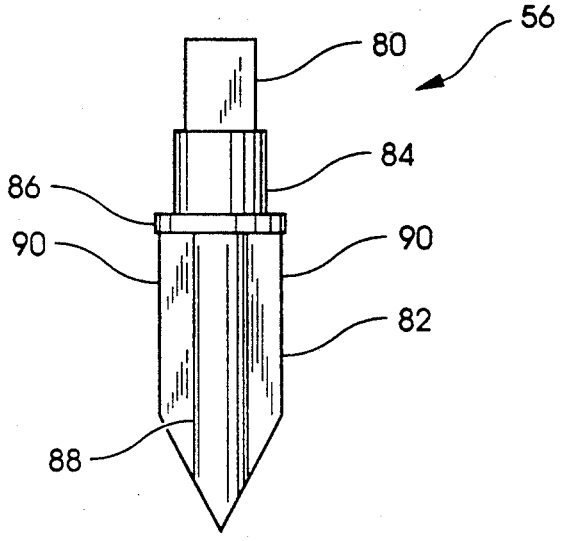
FIG. 11 is a side elevational view of the drive pin shown in FIG. 10.
Figure 12:
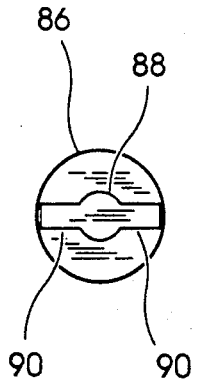
FIG. 12 is a bottom plan view of the drive pin shown in FIG. 11.

Referring now to FIGS. 10–17, the construction of the various components of louver mechanism 40 are shown in greater detail. In general, the various components of the louver mechanism are constructed of a sturdy, lubricious plastic to facilitate manufacture and ensure quiet, trouble-free operation. In FIGS. 10–12, drive pin 56 includes a rectangular pinion engaging end 80 (0.187×0.187 inches×0.250 inches in length) opposite a bladed louver engaging end 82 (0.750 inches in length). Disposed between the pinion and louver engaging ends is a cylindrical collar 84 (0.250 inch diameter) and a circular shoulder 86 (0.318 inch diameter×0.047 inch thickness). Bladed end 82 further includes a smaller cylindrical portion 88 (0.139 inch diameter) having rectangular blades 90 (0.062×0.080 inches) extending either side therefrom. As such, when received in louver 22 drive pin 56 is secured against movement within the louver along multiple axes defined by both cylindrical portion 88 and blades 90. As shown in FIG. 1*a*, drive pin 56 is inserted last in the louver assembly with only the pinion engaging end 80 extending below cover 50. Cylindrical collar 84 is slidably disposed in hole 54 of the cover 50. Shoulder 86 is sized larger than hole 54 and acts as a low friction bushing between the louver 22 and stile 24.

Figure 13:
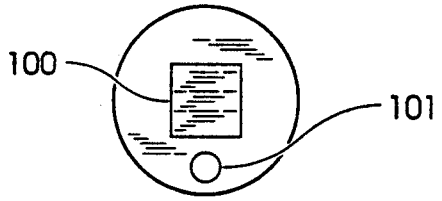
FIG. 13 is a top plan view of a pinion gear of the louver mechanism shown in FIG. 1*a*.
Figure 14:
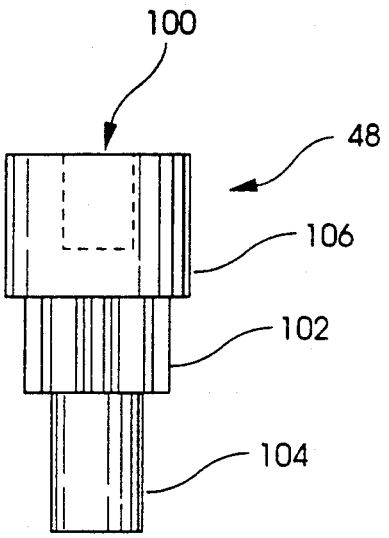
FIG. 14 is a side elevational view of the pinion gear shown in FIG. 13.
Figure 15:
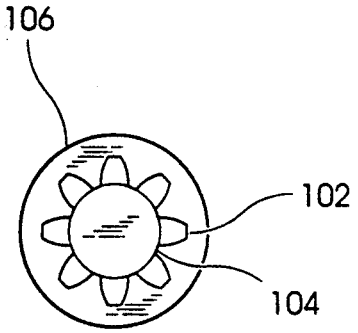
FIG. 15 is a bottom plan view of the pinion gear shown in FIG. 14.

In FIGS. 13–15, pinion gear 48 is shown in greater detail. Pinion gear 48 includes a rectangular slot 100 (0.187×0.187 inches×0.250 inches deep) as means for receiving pinion engaging end 80 of drive pin 56 therein. Slot 100 is indexed at location 101, for example, so that the slots 100 can be aligned to facilitate assembly of the drive pins within the pinion gear. Gear teeth 102 of pinion gear 48 correspond to and mesh with the gear teeth of the longitudinal gear racks. In one specific embodiment, 8 gear teeth are provided having dimensions corresponding to and meshing with the gear teeth of the gear racks 44 and 46. The gear teeth have a diametral pitch of 25.13274, a pressure angle of 20 degrees (spur), a pitch diameter of 0.31831 inches, an outside diameter of 0.3979 inches and a root diameter of 0.2190 inches. A cylindrical mounting pin 104 (0.250 inch diameter×0.375 inches in length) extends from the toothed portion 102 of pinion gear 48 which, in conjunction with the corresponding cylindrical bore 49 of stile 24, provides means for rotationally mounting the pinion gear in the stile. Head end 106 (0.500 inch diameter×0.375 inches in length) of pinion gear 48 is sized just within longitudinal slot 42 to further minimize movement of the pinion gear within slot 42 and ensure smooth and reliable operation of the rack and pinion system.

Figure 16:
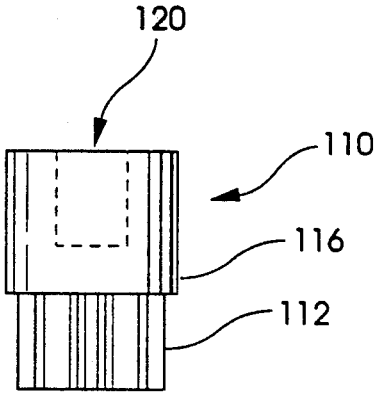
FIG. 16 is a side elevational view of an alternate pinion gear of the louver mechanism shown in FIG. 1*a*.
Figure 17:
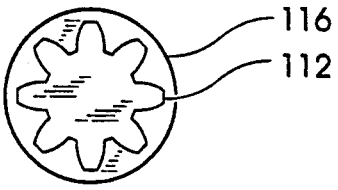
FIG. 17 is a bottom plan view of the pinion gear shown in FIG. 16.

Referring now to FIGS. 16 and 17, an alternate pinion gear 110 is shown having a similar head end 116, gear teeth 112, and rectangular slot 120. However, pinion gear 110 does not include a mounting pin portion. The choice of providing either pinion gear 48 or pinion gear 110 varies with the particular application. Light duty applications would tend to have fewer pinion gears 48 and more pinion gears 110, relying on holes 54 of cover 50 to primarily locate and support pinion gears 110 cantilevered from drive pins 56. Heavy duty applications would tend to have more pinion gears 48 and less pinion gears 110, utilizing both the cover 50 and housing or stile 24 to simply support pinion gears 48 via drive pins 56. In the preferred embodiment, three pinion gears 48 are employed, one at each end of stile 24 and a third midway along stile 24. The remaining louvers are driven by pinion gears 110. Also contemplated is a louver mechanism employing only pinion gears 110, wherein holes 54 of cover 50 locate both the louver and the pinion gears relative the stile. Conversely, a louver mechanism employing only pinion gears 48 is contemplated, wherein each pinion gear is located relative the stile between holes 54 and bores 49.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An enclosed louver mechanism for actuating a plurality of louvers, comprising:

a longitudinal housing including a longitudinal slot therein;

a first longitudinal gear rack slidably disposed in said slot;

a plurality of pinion gears corresponding to the plurality of louvers, each of said plurality of pinion gears including means for receiving a drive pin therein, said plurality of pinion gears being received in said slot adjacent to said first gear rack with the gear teeth of said plurality of pinion gears meshing with the gear teeth of said first gear rack;

a longitudinal cover received in said slot and enclosing said first gear rack and said plurality of pinion gears in said housing, said cover including a plurality of locating holes extending therethrough and corresponding to said plurality of pinion gears; and a plurality of drive pins corresponding to said plurality of pinion gears, each of said plurality of drive pins including a pinion engaging end and a louver engaging end, said pinion engaging end being received through a corresponding one of said plurality of locating holes and in a corresponding one of said receiving means of said plurality of pinion gears and said louver engaging end being received in a corresponding one of the plurality of louvers.

2. The enclosed louver mechanism of claim 1, wherein said first longitudinal gear rack includes first and second gear rack segments connected together.

3. The enclosed louver mechanism of claim 2, wherein each of said first and second gear rack segments includes a tongue at an end thereof and a groove at the other end, said tongue of said first gear rack segment being received in said groove of said second gear rack segment.

4. The enclosed louver mechanism of claim 3, wherein said tongue and groove are dovetailed.

5. The enclosed louver mechanism of claim 1 wherein:

each of said plurality of pinion gears includes a head end having a rectangular slot therein as means for receiving said drive pin; and said pinion engaging end of said drive pin is rectangular in cross-section for receipt in said rectangular slot.

6. The enclosed louver mechanism of claim 1 wherein:

at least one of said plurality of pinion gears further includes a cylindrical mounting pin portion opposite said head end; and said slot includes a cylindrical bore for receiving said cylindrical mounting pin portion therein.

7. The enclosed louver mechanism of claim 1 wherein:

said louver engaging end of said drive pin includes a cylindrical portion and a flared portion extending from said cylindrical portion; and said cylindrical portion locates said drive pin relative to the louver along a first axis and said flared portion locates said drive pin relative to the louver along a second axis.

8. An enclosed louver mechanism for actuating a plurality of louvers, comprising:

a longitudinal housing including a longitudinal slot therein;

a first longitudinal gear rack slidably disposed in said longitudinal slot;

a second longitudinal gear rack slidably disposed in said slot opposite said first gear rack;

a plurality of pinion gears corresponding to the plurality of louvers, each of said plurality of pinion gears including means for receiving a drive pin therein, said plurality of pinion gears being received in said slot between said first and second longitudinal gear racks with the gear teeth of said plurality of pinion gears meshing with the gear teeth of said first and second longitudinal gear racks;

means for rotationally mounting at least one of said plurality of pinion gears in said longitudinal housing;

a longitudinal cover received in said longitudinal slot and enclosing said first and second longitudinal gear racks and said plurality of pinion gears in said housing, said longitudinal cover including means for receiving a plurality of drive pins therethrough; and a plurality of drive pins corresponding to said plurality of pinion gears, each of said plurality of drive pins including a pinion engaging end and a louver engaging end, said pinion engaging end being received through said longitudinal cover and in a corresponding one of said receiving means of said plurality of pinion gears and said louver engaging end being received in a corresponding one of the plurality of louvers.

9. The enclosed louver mechanism of claim 8, wherein:

said first longitudinal gear rack includes first and second gear rack segments connected together; and said second longitudinal gear rack includes third and fourth gear rack segments connected together.

10. The enclosed louver mechanism of claim 9, wherein:

each of said first, second, third and fourth gear rack segments includes a tongue at an end thereof and a groove at the other end; and said first and third gear rack segments are received in said grooves of said second and fourth gear rack segments, respectively.

11. The enclosed louver mechanism of claim 10 wherein said tongues and grooves are dovetailed.

12. The enclosed louver mechanism of claim 8 wherein:

each of said plurality of pinion gears includes a head end having a rectangular slot therein as means for receiving said drive pin; and said pinion engaging end of said drive pin is rectangular in cross-section for receipt in said rectangular slot.

13. The enclosed louver mechanism of claim 12 wherein said means for rotationally mounting at least one of said plurality of pinion gears in said longitudinal housing includes:

a cylindrical mounting pin portion attached to said at least one pinion gear opposite said head end; and a cylindrical bore in said slot for receiving said cylindrical mounting pin portion therein.

14. The enclosed louver mechanism of claim 8 wherein:

said louver engaging end of said drive pin includes a cylindrical portion and a flared portion extending from said cylindrical portion; and said cylindrical portion locates said drive pin relative to the louver along a first axis and said flared portion locates said drive pin relative to the louver along a second axis.

15. A louvered panel employing an enclosed louver mechanism for actuating a plurality of louvers, comprising:

a plurality of louvers;

a frame containing said plurality of louvers, said frame including a first stile opposite a second stile, said first stile including a longitudinal slot therein and said second stile including a plurality of bores therein corresponding to said plurality of louvers;

a first longitudinal gear rack slidably received in said longitudinal slot;

a plurality of pinion gears corresponding to said plurality of louvers, each of said plurality of pinion gears including means for receiving a drive pin therein, said plurality of pinion gears being received in said longitudinal slot adjacent to said first longitudinal gear rack with the gear teeth of said plurality of pinion gears meshing with the gear teeth of said first longitudinal gear rack;

a longitudinal cover received in said slot and enclosing said first gear rack and said plurality of pinion gears in said first stile, said cover including a plurality of locating holes extending therethrough and corresponding to said plurality of pinion gears;

a plurality of drive pins corresponding to said plurality of pinion gears, each of said plurality of drive pins including a pinion engaging end and a louver engaging end, said pinion engaging end being received through a corresponding one of said plurality of holes and in a corresponding one of said receiving means of said plurality of pinion gears and said louver engaging end being received in a corresponding one of the plurality of louvers; and a plurality of louver pins corresponding to said plurality of louvers, each of said plurality of louver pins being received between corresponding ones of said bores and said louvers.

16. The louvered panel of claim 15, and further comprising:

a second longitudinal gear rack slidably received in said longitudinal slot opposite said first gear rack;

wherein said plurality of pinion gears is received in said slot between said first and second gear racks.

17. The louvered panel of claim 16, and further comprising means for rotationally mounting at least one of said plurality of pinion gears in said longitudinal housing.

18. The louver panel of claim 17, wherein:

said first longitudinal gear rack includes first and second gear rack segments connected together; and said second longitudinal gear rack includes third and fourth gear rack segments connected together.

19. The louver panel of claim 18, wherein:

each of said plurality of pinion gears includes a head end having a rectangular slot therein as means for receiving said drive pin, said pinion engaging end of said drive pin being rectangular in cross-section for receipt in said rectangular slot; and said means for rotationally mounting at least one of said plurality of pinion gears in said longitudinal housing includes a cylindrical mounting pin portion attached to said at least one pinion gear opposite said head end and a cylindrical bore in said slot for receiving said cylindrical mounting pin portion therein.

20. The enclosed louver mechanism of claim 19 wherein:

said louver engaging end of said drive pin includes a cylindrical portion and a flared portion extending from said cylindrical portion; and said cylindrical portion locates said drive pin relative to the louver along a first axis and said flared portion locates said drive pin relative to the louver along a second axis.

* * * * *

UNITED STATES PATENT AND TRADEMARK OFFICE

CERTIFICATE OF CORRECTION

PATENT NO. : 5,216,837

DATED : June 8, 1993

INVENTOR(S) : Jay R. Cleaver, Richard E. LaMay, Ivan Dusevic

It is certified that error appears in the above-identified patent and that said Letters Patent is hereby corrected as shown below:

Column 8, claim 10, line 38, after the word "said" add --tongues of said--.

Signed and Sealed this

First Day of February, 1994

Bruce Lehman

*Attest:*

BRUCE LEHMAN

*Attesting Officer*

*Commissioner of Patents and Trademarks*